United States Patent [19]

Jungesjo

[11] 4,155,236

[45] May 22, 1979

[54] TOOTH FORMING MACHINE

[75] Inventor: Harald N. Jungesjo, Rochester, Mich.

[73] Assignee: Anderson-Cook, Inc., Fraser, Mich.

[21] Appl. No.: 871,310

[22] Filed: Jan. 23, 1978

[51] Int. Cl.[2] ..... B21D 17/04

[52] U.S. Cl. ..... 72/88; 72/453.18; 92/108

[58] Field of Search ..... 72/88, 90, 453.18; 92/108

[56] References Cited

U.S. PATENT DOCUMENTS

| | | | |
|---|---|---|---|
| 788,876 | 5/1905 | Beche | 72/453.18 X |
| 2,995,964 | 8/1961 | Drader | 72/88 |
| 3,949,650 | 4/1976 | Blatt | 92/108 |
| 3,982,415 | 9/1976 | Killop | 72/88 |

*Primary Examiner*—Milton S. Mehr

*Attorney, Agent, or Firm*—Reising, Ethington, Barnard, Perry & Brooks

[57] ABSTRACT

A tooth forming machine disclosed provides high production output and accurately controlled tooth forming due to the provision of equal displacement hydraulic cylinders which reciprocate die racks on upper and lower base portions connected by a base connecting portion and preloaded deflection control connections. Each cylinder includes a hollow housing, a slidable piston received within the housing, a hollow connecting rod secured to the slidable piston and projecting outwardly from the housing, and a stationary piston received within the hollow rod while allowing movement of the slidable piston. An annular pull chamber and a push chamber of the same cross-sectional area are defined by the cylinder components and alternately fed pressurized hydraulic fluid from a closed loop pump system while fluid from the other chamber is returned to the pump system in order to extend or retract the cylinder and thereby move the associated die rack in one direction or the other. Each deflection control connection includes a sleeve having opposite ends respectively engaged with the upper and lower base portions and a bolt that extends through the sleeve and these base portions as well as a nut that is tightened onto the bolt to preload the sleeve. During movement of the die racks from an end-to-end relationship into an overlapping relationship by the equal displacement cylinders, the preloading of the sleeves prevents deflection between the upper and lower base portions.

4 Claims, 3 Drawing Figures

TOOTH FORMING MACHINE

TECHNICAL FIELD

This invention relates to tooth forming machines having die racks that are reciprocally driven along rectilinear paths to form teeth in a workpiece such as during spline forming, gear forming, or gear burnishing operations.

BACKGROUND ART

U.S. Pat. Nos. 3,015,243; 3,115,052; 3,214,951; and 3,793,866 disclose machines for forming teeth in a workpiece by reciprocal movement of a pair of die racks that are driven along rectilinear paths. Hydraulic cylinders are utilized in the first three mentioned patents to move the die racks in a reciprocal manner along the rectilinear paths on opposite sides of the workpiece on which the teeth are being formed. One problem with conventional hydraulic cylinders used with machines of this type is that a different amount of fluid must be supplied to opposite sides of the cylinder piston during the extending and retracting strokes of the piston connecting rod of the cylinder. A greater amount of fluid must be supplied to the cylinder during extension than during retraction due to the larger area of the piston on the side which is not connected to the rod of the piston. Consequently, fluid pumped with equal pressure to the cylinder requires a greater time period to execute an extending stroke than a retracting stroke. This naturally makes the complete machine cycle time greater than twice the time of a retracting stroke. Also, pump apparatus for operating the machine cylinders is necessarily more complex due to the requirement of supplying a greater amount of fluid to the cylinder during one direction of movement than the other direction of movement.

Reciprocally driven cylinders are disclosed by U.S. Pat. Nos. 2,193,736; 2,624,318; 2,649,842; 2,664,859; 3,200,596; 3,592,108; 3,710,689; 3,744,375; and 3,949,650; and by British Patent specification No. 1,197,976.

In the machine disclosed by the U.S. Pat. No. 3,793,866 patent mentioned above hydraulic fluid rotary motors are used to drive the racks in opposite directions along rectilinear paths to provide tooth forming. Upper and lower base portions on which the racks are slidably mounted are interconnected by a connecting portion of the machine base and by a pair of rods whose opposite ends are threaded to nuts on the upper and lower base portions. As the hydraulic fluid rotary motors drive the die racks to form teeth in a workpiece, the rods limit the degree of deflection permitted between the upper and lower base portions in cooperation with the connecting portion of the base.

DISCLOSURE OF THE INVENTION

One object of the present invention is to provide an improved tooth forming machine including a pair of equal displacement hydraulic cylinders for reciprocating rectilinear die racks on upper and lower portions of the machine base by a closed loop pumped system which supplies pressurized hydraulic fluid to the cylinders so as to thereby provide a relatively fast machine cycle.

Another object of the present invention is to provide an improved tooth forming machine including a pair of equal displacement hydraulic cylinders for reciprocating a pair of straight die racks on upper and lower base portions of the machine base by a closed loop pump system so as to thereby provide a relatively fast machine cycle, and wherein the upper and lower base portions are interconnected by deflection control connections that each include a bolt and sleeve construction extending between the upper and lower base portions in a preloaded condition to prevent deflection between these base portions as the cylinders reciprocate the dies to form teeth on the workpiece.

In carrying out the above objects, each of the cylinders includes a hollow housing mounted on the upper or lower base portion and a piston sealingly slidable within the housing and cooperating therewith to define a first chamber. The slidable piston of each cylinder includes a hollow connecting rod extending out through the housing to reciprocally drive the associated die rack. A stationary piston of each cylinder is mounted within the housing thereof and is received within the hollow connecting rod of the slidable piston in a slidably sealed relationship that allows sliding of the rod and defines a second chamber within the rod. Each of the chambers has the same cross-sectional area as the other transversely of the direction of sliding piston movement. A closed loop pump system supplies pressurized hydraulic fluid to one chamber or the other of each cylinder while receiving hydraulic fluid from the opposite chamber in order to reciprocate the rods and move the die racks. Pressurized hydraulic fluid is thus supplied to one chamber of each cylinder by the pump system and hydraulic fluid is received from the other chamber of each cylinder to retract the rods thereof and move the die racks in one direction. Similarly, pressurized hydraulic fluid is supplied to the other chamber of each cylinder and hydraulic fluid is received from the one chamber of each cylinder to extend the rods and move the die racks in the other direction.

In the preferred construction of the machine, each cylinder is mounted on the machine base so that forming of the teeth by the die racks is performed as the rods are retracted. The piston of each cylinder defines an annular pull chamber to which the pressurized hydraulic fluid is pumped to provide the rod retraction. After the tooth forming operation, pressurized hydraulic fluid is pumped to a push chamber cooperatively defined by the stationary piston and the hollow connecting rod of the cylinder. Each of the pull and push chambers has the same cross-sectional area so that the pump system can receive hydraulic fluid from the push chamber when fluid is pumped to the pull chamber and can likewise receive hydraulic fluid from the pull chamber when fluid is pumped to the push chamber. For any distance of rod movement, one of the chambers is increased in volume the same amount the other chamber is decreased in volume. This "equal displacement" feature of the cylinders as utilized with the machine and the closed loop pump system provides the relatively fast machine cycle time and the relatively uncomplicated closed loop pump system.

Each of the deflection control connections limits movement between the upper and lower base portions as the equal displacement cylinders drive the die racks to perform the tooth forming operation. A sleeve of each connection has upper and lower ends respectively seated against the upper and lower base portions. Each connection also includes a bolt that extends through the associated sleeve and the upper and lower base portions. Tightening of a nut onto the bolt preloads the connection by compressing the sleeve. Deflection between the base portions is prevented during the tooth forming by the preloaded condition of the connections.

BEST MODE FOR CARRYING OUT THE INVENTION

Figure 1:
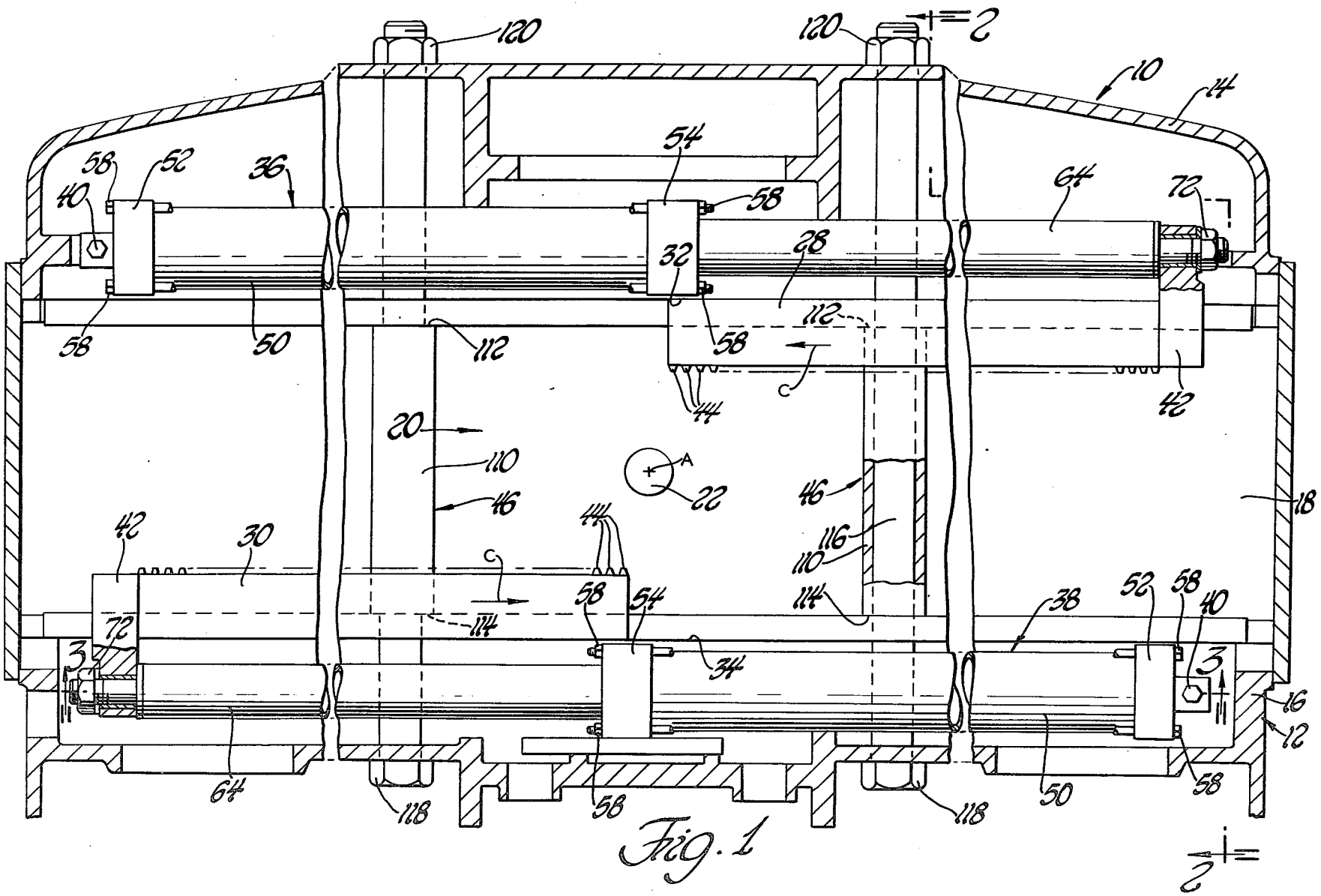
FIG. 1 is an elevation view taken partially in section through a tooth forming machine constructed according to the present invention.
Figures 2, 3:
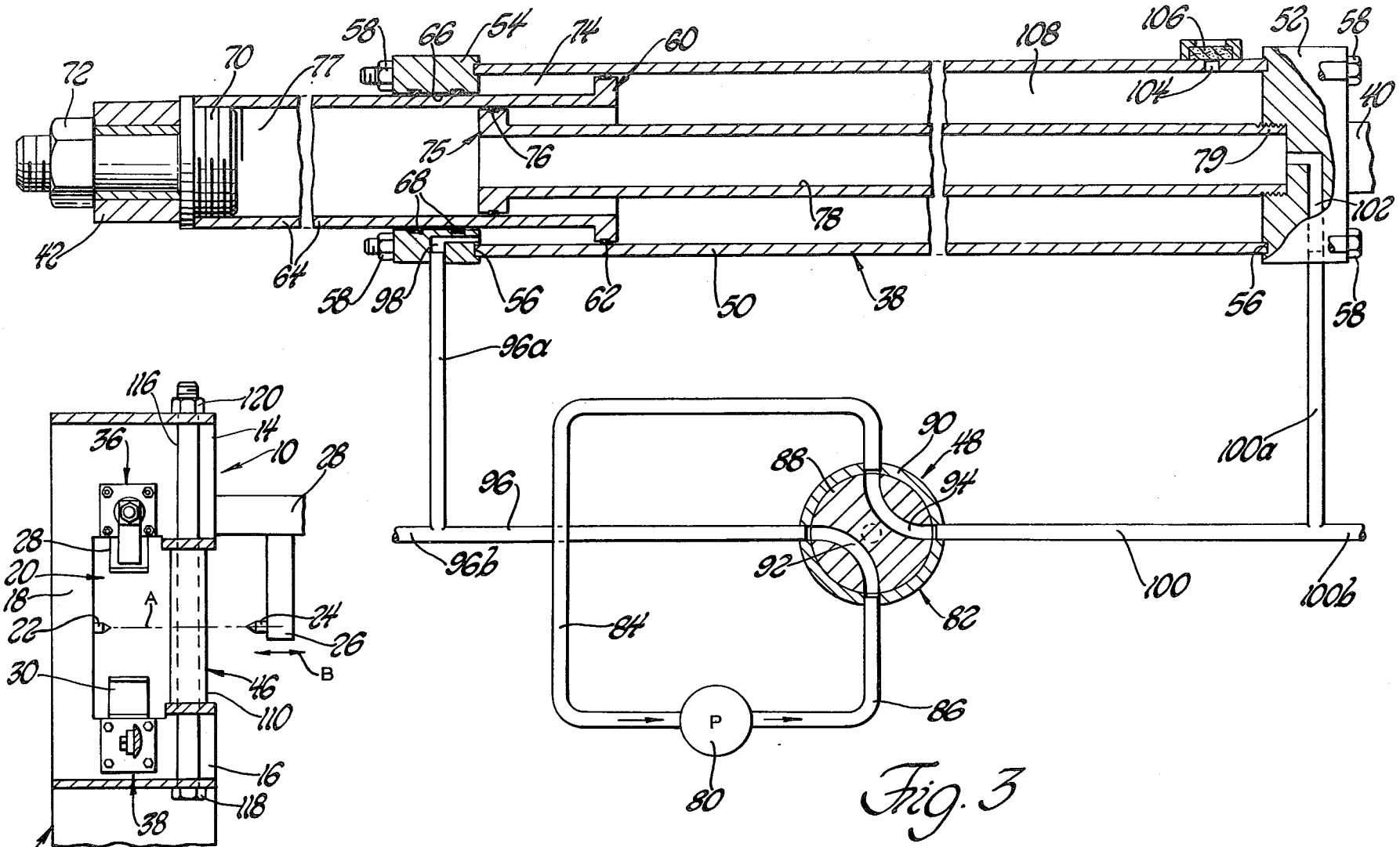
FIG. 2 is a schematic view of the machine taken generally in the direction of line 2—2 in FIG. 1.
FIG. 3 is a sectional view through one of the machine cylinders taken along line 3—3 of FIG. 1 and also illustrates a closed loop pump system which operates the cylinders.

Referring to FIGS. 1 and 2, a tooth forming machine constructed according to the present invention is indicated collectively by reference numeral 10 and includes a base 12 that supports the machine on the factory floor. Machine base 12 includes an upper base portion 14, a lower base portion 16, and a connecting portion 18 that projects upwardly from the rear side of the lower base portion. Upper base portion 14 projects horizontally above the lower base portion 16 supported on the upper end of the connecting portion 18 and cooperates with the lower base portion to define a confined work space 20. Headstock spindle 22 is mounted on the connecting portion 18 of the base within the work space 20 and cooperates with a tailstock spindle 24 to rotatably support a workpiece along the axis A. A tailstock spindle support 26 supports the spindle 24 and is movable toward and away from the headstock spindle 22 along the direction of arrows B supported on an arm 28 that projects from the upper base portion 14. During mounting of a workpiece, the tailstock support 26 is moved toward the connecting portion 18 of the base until the headstock spindle 22 and the tailstock spindle 24 engage and rotatably support the workpiece along the axis A. Movement of the support 26 away from the connecting portion 18 of the base subsequently allows the workpiece to be removed from between the headstock and tailstock spindles 22 and 24.

Tooth forming is performed on a mounted workpiece by a pair of upper and lower die racks 28 and 30 that are slidably mounted by respective slideways 32 and 34 on the upper and lower base portions for movement in a rectilinear path along the directions shown by arrows C. Die racks 28 and 30 are usually supported on the slideways by respective slide tables (not shown) on which the racks can be properly positioned by conventional tool holders. A pair of equal displacement hydraulic cylinders 36 and 38 whose construction will be more fully hereinafter described are respectively mounted on the upper and lower base portions by lug and bolt connections 40 and are connected to plates 42 mounted in a suitable manner on the trailing ends of the die racks. Retraction of the cylinders 36 and 38 moves the die racks 28 and 30 in the directions of arrows C from an end-to-end relationship into an overlapping relationship so that teeth 44 spaced along the length of the die racks engage the mounted workpiece on its upper and lower sides to perform toothed forming in a rolling operation. After the tooth forming is performed, the cylinders 36 and 38 are extended to move the die racks 28 and 30 in the opposite direction as arrows C back to the end-to-end relationship ready to begin another cycle. During the forming of the teeth, a pair of deflection control connections 46 limit the deflection between the upper and lower base portions 14 and 16, in a manner that is hereinafter more fully described, in order to provide precision in forming the teeth on the workpiece.

With reference to FIG. 3, lower cylinder 38 will be described in greater detail in connection with a hydraulic pump system 48 of the machine and it is to be understood that the upper cylinder 36 has the same construction as the lower cylinder but is oriented in the opposite direction. Cylinder 38 includes a hollow housing 50 of an elongated cylindrical construction with a round cross section. End plates 52 and 54 of the cylinder include respective annular grooves 56 that receive the opposite ends of the housing 50, and conventional corner nut and bolt connections 58 extend between the end plates 52 and 54 to maintain the assembled condition of the cylinder. A slidable piston 60 is received within the housing 50 and includes an O-ring 62 that allows the piston to slide along the length of the cylinder in a sealed relationship. Piston 60 includes a hollow connecting rod 64 that extends out through a hole 66 in the end plate 54 slidably sealed by a pair of O-rings 68. At its outer end the connecting rod 64 receives a threaded plug 70 having a stud and nut connection 72 that is secured to the plate 42 on the associated die rack. At the inner end of the connecting rod 64, the piston 60 and the cylinder housing 54 cooperate to define an annular pull chamber 74. Within the hollow connecting rod 64, a stationary piston 75 of the cylinder housing is sealed by an O-ring 76 to allow the sliding rod movement in a sealed relationship while cooperating therewith to define a sealed push chamber 77. Piston 75 has an elongated interior 78 that communicates with chamber 77 and also has a distal end 79 threaded into the end plate 52. Pull and push chambers 74 and 77 have the same cross-sectional area taken transversely to the direction of the movement of the slidable piston 60.

Pump system 48 of the machine is shown in FIG. 3 as including a hydraulic pump 80 and a control valve 82. Pump 80 receives hydraulic fluid through an inlet conduit 84 from the control valve 82 and delivers pressurized hydraulic fluid through an outlet conduit 86 to the control valve. A valve element 88 of control valve 82 is rotatably mounted within a housing 90 thereof and includes a pair of curved passages 92 and 94 for controlling the flow of hydraulic fluid to and from the pump. One conduit 96 is connected to the valve housing 90 and includes a branch conduit 96*a* that is communicated with the pull chamber 74 of cylinder 38 through an L-shaped passage 98 of the cylinder end plate 54. Conduit 96 also includes a branch conduit 96*b* that is communicated with the pull chamber of the other cylinder. Another conduit 100 connected to the valve housing 90 includes a branch conduit 100*a* that is communicated with the push chamber 77 through an L-shaped passage 102 in the end plate 52 and through the interior 78 of the stationary piston 75. Conduit 100 also includes a branch conduit 100*b* that is communicated with the push chamber of the other cylinder.

Pump system 48 can function in a closed loop manner to extend and retract the piston connecting rod 64 due to the equal cross-sectional areas of the pull chamber 74 and the push chamber 77. For any distance of rod movement, one of the chambers 74 or 77 is increased in volume the same amount the other chamber is decreased in volume. This "equal displacement" feature of the cylinders facilitates the pump structure and operation of the machine.

With the valve element 88 shown as in FIG. 3, the pressurized fluid from the pump 80 is supplied through the passage 92 to the conduit 96 and to the branch conduits 96*a* and *b* for delivery to the pull chambers 74 of the cylinders. Pressurized fluid so delivered moves the slidable piston 60 of the cylinder to retract the connecting rod 64 thereof and move the die racks from the end-to-end relationship into the overlapping relationship as the tooth forming is performed in the manner previously described. As the cylinder retraction takes place, hydraulic fluid from the cylinder push chambers 77 is forced through the interiors 78 of the stationary pistons 75 and through the associated end plate passages 102 into the branch conduits 100*a* and *b* for delivery to the control valve 82 through conduit 100. Passage 94 of the valve element 88 then directs the fluid from conduit 100 to the pump inlet conduit 84.

After the tooth forming is performed, the valve element 88 is rotated clockwise 90° from the position shown so that the pressurized hydraulic fluid from the pump outlet conduit 86 is fed through passage 94 to the conduit 100. Branch conduits 100*a* and *b* then feed the pressurized hydraulic fluid through the end plate passages 102 and through the interiors 78 of the stationary pistons 75 to the push chamber 77 of the cylinders in order to extend the connecting rods 64 thereof and move the die racks back to their original positions in preparation for another tooth forming operation. Hydraulic fluid is forced from the pull chamber 74 during the cylinder extension through the end plate passages 98 to the branch conduits 96*a* and *b* for delivery through the conduit 96 to the control valve 82. Passage 92 of the valve element 98 then feeds the fluid delivered from conduit 96 to the inlet conduit 84 of the pump for pumping to the push chambers. As the piston 60 is moved back and forth during cylinder retraction and extension, an air port 104 to the right of the piston 60 allows air to move in and out of the cylinder through a filter 106 so that no vacuum or pressure is generated within the cylinder chamber 108 around the elongated tube of the stationary piston 75. It is readily apparent that the pump system 82 for operating the cylinders is relatively uncomplicated due to the manner in which fluid can be pumped back and forth between the pull and push chambers 74 and 77 by virtue of the same cross-sectional areas of these chambers. Also, it is preferable for the cylinders to perform the tooth forming during the retraction stroke rather than during the extension stroke so that no buckling forces are present between the ends of the cylinders as the teeth are being formed.

Deflection control connections 46 limit deflection between the upper and lower base portions 14 and 16 as the pump system 48 drives the die racks to perform the tooth forming operation. Each of the connections 46 includes a sleeve 110 having an upper end 112 that is seated against the lower side of the upper base portion 14 and also has a lower end 114 that is seated against the upper side of the lower base portion 16. A bolt 116 of each connection 46 extends through the upper and lower base portions 14 and 16 and through the associated sleeve 110 with the bolt head 118 seated against the lower side of the lower base portion 16. Upper ends of the bolts 116 receive associated nuts 120 of the connections 46 in order to preload the sleeves 110 between the upper and lower base portions 14 and 16. Tightening of the nuts 120 compresses the sleeves 110 between the upper and lower base portions so that no deflection takes place between the base portions during the tooth forming until the preload force is overcome. Precise forming of teeth on the workpiece is possible as a result of this type of the preloaded deflection control connections.

While the best mode for practicing this invention has been described in detail, those familiar with the art to which this invention relates will appreciate that there are other ways of practicing the invention as described by the following claims.

What is claimed is:

1. A tooth forming machine comprising: a base having a lower base portion and a connecting portion that projects upwardly from the lower base portion; the base also including an upper base portion that projects horizontally from the connecting portion above the lower base portion to define a confined work space; each of the base portions have a slideway adapted to mount an associated toothed die rack for reciprocal movement so as to form teeth on a workpiece; a pair of hydraulic cylinders for respectively reciprocating the die racks; each cylinder including a hollow housing mounted on one of the base portions and a piston sealingly slidable within the housing and cooperating therewith to define a first chamber; the slidable piston of each cylinder having a hollow connecting rod that extends out through the housing thereof to reciprocally drive a die rack mounted on the associated base portion; the housing of each cylinder also including a stationary piston received within the hollow connecting rod of the slidable piston in a sealed relationship that allows sliding thereof and defines a second chamber; said first and second chambers having the same cross-sectional area transversely of the direction of movement of the slidable piston; and a closed loop pump system for supplying pressurized hydraulic fluid to one chamber and receiving hydraulic fluid from the other chamber of each cylinder to thereby retract the rods thereof and move the die racks in one direction and for alternately supplying pressurized hydraulic fluid to the other chamber and receiving hydraulic fluid from the one chamber of each cylinder to thereby extend the rods thereof and move the die racks in the other direction.

2. A tooth forming machine comprising: a base having a lower base portion and a connecting portion that projects upwardly from the lower base portion; the base also including an upper base portion that projects horizontally from the connecting portion above the lower base portion to define a confined work space; each of the base portions having a slideway adapted to mount an associated toothed die rack for reciprocal movement so as to form teeth on a workpiece; a pair of hydraulic cylinders for respectively reciprocating the die racks; each cylinder including a hollow housing mounted on one of the base portions and a piston sealingly slidable within the housing and cooperating therewith to define a pull chamber; the slidable piston of each cylinder having a hollow connecting rod that extends out through the housing thereof to reciprocally drive a die rack mounted on the associated base portion; the housing of each cylinder also including a stationary piston received within the hollow connecting rod of the slidable piston in a sealed relationship that allows sliding thereof and defines a push chamber; said pull and push chambers having the same cross-sectional area transversely of the direction of movement of the slidable piston; and a closed loop pump system for supplying pressurized hydraulic fluid to the pull chamber and receiving hydraulic fluid from the push chamber of each cylinder to thereby retract the rods thereof and move the die racks from an end-to-end relationship to an overlapping relationship and for alternately supplying pressurized hydraulic fluid to the push chamber and receiving hydraulic fluid from the pull chamber of each cylinder to thereby extend the rods thereof and move the die racks back to the end-to-end relationship.

3. A tooth forming machine comprising: a base having a lower base portion and a connecting portion that projects upwardly from the lower base portion; the base also including an upper base portion that projects horizontally from the connecting portion above the lower base portion to define a confined work space; each of the base portions having a slideway adapted to mount an associated toothed die rack for reciprocal movement so as to form teeth on a workpiece; a pair of deflection control connections extending between the upper and lower base portions; each of said connections including a sleeve having opposite ends respectively engaged with the base portions and a bolt that extends through the sleeve and the base portions and each connection also including a nut threaded onto the bolt to preload the sleeve and thereby prevent deflection of the base portions during the tooth forming; a pair of hydraulic cylinders for respectively reciprocating the die racks; each cylinder including a hollow housing mounted on one of the base portions and a piston sealingly slidable within the housing and cooperating therewith to define a first chamber; the slidable piston of each cylinder having a hollow connecting rod that extends out through the housing thereof to reciprocally drive a die rack mounted on the associated base portion; the housing of each cylinder also including a stationary piston received within the hollow connecting rod of the slidable piston in a sealed relationship that allows sliding thereof and defines a second chamber; said first and second chambers having the same cross-sectional area taken transversely of the direction of movement of the slidable piston; and a closed loop pump system for supplying pressurized hydraulic fluid to one chamber and receiving hydraulic fluid from the other chamber of each cylinder to thereby retract the rods thereof and move the die racks in one direction and for alternately supplying pressurized hydraulic fluid to the other chamber and receiving hydraulic fluid from the one chamber of each cylinder to thereby extend the rods thereof and move the die racks in the other direction.

4. A tooth forming machine comprising: a base having a lower base portion and a connecting portion that projects upwardly from the lower base portion; the base also including an upper base portion that projects horizontally from the connecting portion above the lower base portion to define a confined work space; each of the base portions having a slideway adapted to mount an associated toothed die rack for reciprocal movement so as to form teeth on a workpiece; a pair of deflection control connections extending between the upper and lower base portions; each of said connections including a sleeve having opposite ends respectively engaged with the base portions and a bolt that extends through the sleeve and the base portions and each connection also including a nut threaded onto the bolt to preload the sleeve and thereby prevent deflection of the base portions during the tooth forming; a pair of hydraulic cylinders for respectively reciprocating the die racks; each cylinder including a hollow housing mounted on one of the base portions and an annular piston sealingly slidable within the housing and cooperating therewith to define an annular pull chamber; the slidable piston of each cylinder having a hollow connecting rod that extends out through the housing thereof to reciprocally drive a die rack mounted on the associated base portion; the housing of each cylinder also including a stationary piston received within the hollow connective rod of the slidable piston in a sealed relationship that allows sliding thereof and defines a push chamber; said pull and push chambers having the same cross-sectional area transversely of the direction of movement of the slidable piston; and a closed loop pump system for supplying pressurized hydraulic fluid to the annular pull chamber and receiving hydraulic fluid from the push chamber of each cylinder to thereby retract the rods thereof and move the die racks from an end-to-end relationship to an overlapping relationship and for alternately supplying pressurized hydraulic fluid to the push chamber and receiving hydraulic fluid from the annular pull chamber of each cylinder to thereby extend the rods thereof and move the die racks back to the end-to-end relationship.

* * * * *